United States Patent [19]

Shalson

[11] Patent Number: 4,618,080

[45] Date of Patent: Oct. 21, 1986

[54] GARMENT HANGER

[75] Inventor: Peter Shalson, Radlett, United Kingdom

[73] Assignee: Braitrim (London) Limited, London, United Kingdom

[21] Appl. No.: 661,694

[22] Filed: Oct. 17, 1984

[30] Foreign Application Priority Data

Oct. 17, 1983 [GB] United Kingdom ..... 8327739

[51] Int. Cl.[4] ..... A47G 25/30

[52] U.S. Cl. ..... 223/95

[58] Field of Search ..... 223/95, 96, 92, 93, 223/85, 86, 87, 88, 89, 90, 91, 94; D6/315-328

[56] References Cited

U.S. PATENT DOCUMENTS

| | | | |
|---|---|---|---|
| D. 33,665 | 12/1900 | Kramer | 223/95 |
| 445,099 | 1/1891 | Traut | 223/85 |
| 2,907,505 | 10/1959 | Kinsey | 223/95 |
| 3,411,679 | 11/1968 | Rooz | 223/88 |
| 3,445,045 | 5/1969 | Panning | 223/95 |

FOREIGN PATENT DOCUMENTS

| | | | |
|---|---|---|---|
| 87007 | of 1966 | France | 223/95 |
| 2406421 | 10/1978 | France | 223/96 |
| 1514978 | 6/1978 | United Kingdom | 223/96 |
| 2120542 | 12/1983 | United Kingdom | 223/95 |

*Primary Examiner*—Louis K. Rimrodt
*Assistant Examiner*—Joseph S. Machuga
*Attorney, Agent, or Firm*—Ladas & Parry

[57] ABSTRACT

A garment hanger has an elongate bar structure (3) having a hook (5) by which the hanger can be suspended; a pair of limbs (9) each carry a garment retaining element (17) and are hingedly secured to a respective end portion of the bar structure by at least two parallel links (13) such that the portions of the limbs are substantially parallel to the end portions of the bar structure. Each limb has resilient means (for instance by being a leaf spring) which resist inward movement of the limb in the direction towards the other limb. The hanger can readily be formed from a single plastics moulding. The construction provides for garments of different size to be hung at the same level and avoids creep in the garment.

13 Claims, 1 Drawing Figure

1/1
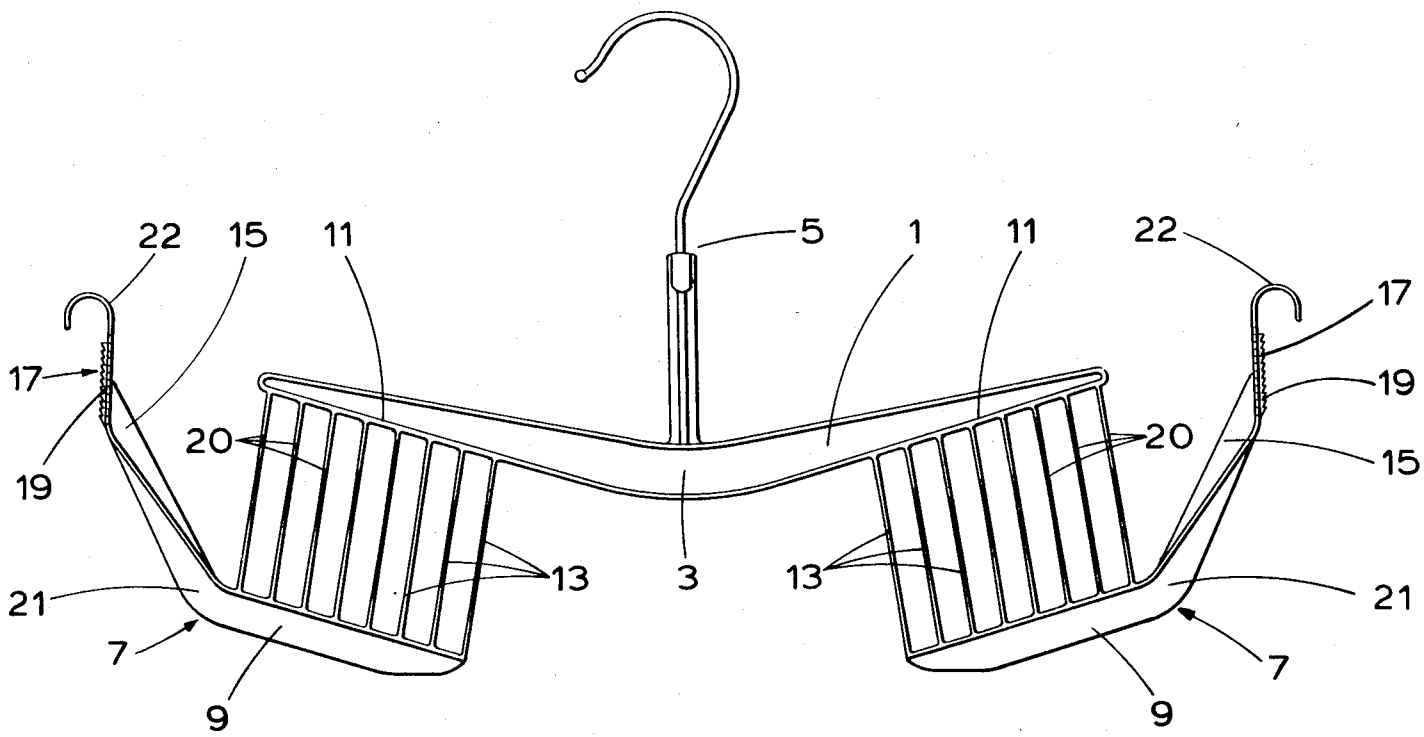

GARMENT HANGER

This invention relates to a garmet hanger which is particularly suitable for supporting skirts and trousers. The hanger is arranged to support the skirt or trousers at the waist band of the garment. To this end, the hanger provides a pair of spaced apart garment retaining elements which can bear against the inside surface of the waistband when the garment is placed on the hanger.

A conventional hanger has arms extending from a central body which usually has a hook or other means for suspending the hanger. Skirts and slacks can be suspended by slipping loops fixed to the waistband of the garments over the arms but this is not very practical for commercial purposes. Moreover there is a need for a hanger which can be supplied with the garment and will stay positioned in the garment during transportation.

As skirts and trousers with different sizes of waistband have to be supported on hangers, it is desirable that garment hangers should be capable of supporting garments having a range of different sizes of waistband.

Known hangers permit skirts and trousers to be supported on them but usually suffer from the disadvantage that garments of different sizes are suspended at different levels relative to the suspension hook.

Also in order to provide for multiple waist sizes the constructions are often complex with various elements which have to be assembled.

Existing hangers are often difficult to insert into the waistband. For example, where resilient elements move towards the centre of the hanger, they often must be compressed before insertion into the waistband.

Thus in one existing form of skirt hanger a central body is provided within which are provided sliding arms biassed outwardly by springs. In specification No. GB-A-2 012 581 there is described a garment hanger with upwardly inclined tensioning upper arms on the ends of which are garment gripping devices and above these downwardly inclined arms connecting to the middle of the lower arms with a resilient means tending to straighten the upper and lower arms.

In specification No. GB-A-1 514 978 is described a structure in which resilient arms extend outwardly and upwardly with garment gripping devices at the free ends of the arms.

These latter constructions tend to display garments of different sizes at different heights. Also the necessary pressure on the waistband of the garment from the resilient structures causes garment creep i.e. increase in waist size.

It is an object of the present invention that the hanger should be capable of supporting garments of different sizes at approximately the same level relative to the hook.

According to the present invention, a garment hanger comprises an elongate bar structure having means by which the hanger can be suspended; a pair of limbs each providing a garment retaining element and each having a portion hingedly secured to a respective end portion of the bar structure by at least two parallel links such that said portions of the limbs are substantially parallel to the end portions of the bar structure; and each limb having resilient means which resist inward movement of the limb in the direction towards the other limb.

The term hingedly secured means that the relationship of the link, the end portion and the limb permits movement of the limb in parallel relation to and from the bar. This may be achievable by a distortion in the link equivalant to a rotational movement of the link about a hinge axis.

The parallel links permit the limbs to move towards and away from each other to a limited extent, thereby adjusting the separation of the retaining elements for a garment when it is supported on the hanger. This permits a range of sizes to be accommodated on the hanger. The resilient means provide forces which urge the retaining elements apart to extend the waistband; when the elements are surfaces bearing against the inside of the waistband they will hold the garment on the hanger. The retaining elements move inwardly at substantially the same level compared with the suspension means. The parallel link structure creates a parallelogram of forces whereby the greater the weight of the garment the greater the outward movement of the ends so enhancing the support for the garment. In one embodiment of the invention, the links which connect the limb to the bar structure are leaf springs which provide the required resilience.

It is convenient for the entire hanger, apart perhaps from the support hook, to be formed in a single moulding from plastics material and, to this end, it is convenient for each limb to be secured to the structure by a multiplicity of parallel webs of plastics material and these webs constitute the hinged links and the resilient means.

The outer end portions of the elongate bar structure may be inclined upwardly and outwardly with respect to a central portion of the bar structure to which the support means is attached. With this form of construction, the greater part of the hanger is positioned inside the waistband when a garment is supported on the hanger, thus only a very small part of the hanger is visible when the garment is supported on it.

The garment gripping elments can be serrated surfaces with serrations directed outwardly or other surface capable of holding the garment. Thus the elements will usually be on the outer ends of the limbs but for clips or other gripping means they could be mounted inwardly of the outer ends of the limbs. A garment gripping means could comprise jaw bearing against each other. One arm of a jaw could be integral with the end of the limb (and rigidity could be enhanced by a strut from the arm). The second arm of the jaw can be resiliently deformable from a closed position adjacent to the other jaw. Suitable jaw structures could be those illustrated in specification No. GB-A-1 514 978.

Particularly where the gripping elements are clips or other means not dependent on the outward movement of the limbs they can be positioned to grip the garment at right angles to the plane of movement of the limbs.

In the embodiment of the invention where the construction is by a simple moulding of plastics material, the material used should be a polymeric material which provide to the webs the necessary resiliency. The material and dimensions of the web should on the one hand permit the necessary movement and resiliency for return and on the other hand resist creep in the plastics material while the web is compressed in the garment.

In another aspect of the invention there is provided a garment hanger with garment gripping means mounted at the ends of arms resiliently biassed against inward movement of said ends toward the centre of the hanger and below said gripping means garment guides extending downwardly and inwardly to a distance apart less than the waist width of the garment.

By providing said guides the lower portion of the hanger comprising the lower ends of the guides can be inserted readily into the garment and, as the hanger moves into the garment, the pressure of the garment waistband compresses the arms against the resilient bias until the waistband is guided into or onto the gripping means.

In the illustrated embodiment of the present invention the positioning of the guides on the limbs and extending upwardly and outwards towards the garment gripping means provides a very convenient means of compressing the limbs inwardly as the inward force is in line with the movement of the limb.

In another construction of hanger where the ends are biassed outwards by springs in the same horizontal plane when the initial compression on the end of the guides below that plane might create a moment of forces which would be more difficult to handle but would still avoid the problem of compressing before any insertion of the hanger into the garment. Thus the arms could be attached to the guides centrally between the lower end and the garment gripping means.

The FIGURE is a side elevation of a garment hanger in accordance with the present invention.

A hanger for garments such as skirts and trousers has an elongate bar structure 1 having a central portion 3 to which a support hook 5 is attached. The outer ends of the bar structure are inclined upwardly with respect to the central part 3 by a small extent. A pair of limbs 7 each have a connecting portion 9 which is substantially parallel with a respective end portion 11 of the bar structure. The a connecting portion 9 of the limb and the portion 11 of the bar structure are connected by a multiplicity of thin webs 13 of plastics material which are arranged substantially parallel to each other. In the arrangement shown, the webs are formed integral with the hanger and they constitute hinged links which permit the limbs 7 to move relative to the bar structure 1 in the direction towards and away from each other. Because the webs 13 are parallel to each other and the portions 9 and 11 are parallel to each other, the movement of each limb 7 is substantially parallel to the corresponding end portion of the bar structure. Each limb carries an upstanding support 15 which provides a garment gripping surface 17 as garment retaining element which surface may be roughened or provided with teeth 19 or upwardly directed serrations to hold a waistband of a garment which is pressed against the surface 17. Such gripping surface can be replaced by other gripping means e.g. a clip. Above the surface 17 is a stop 22.

The support 15 extends upward and outwardly from the point of junction 21 with limb 9 to provide a guide for the garment onto garment gripping portion 17. The outside distance apart of the points of junction 21 is less than the average width of a waistband while the distance apart of surfaces 17 is greater than the average waistband. Movement of the hanger into the waistband compresses the limbs 9 towards each other.

It will be appreciated that, when the limbs 7 are moved inwardly towards each other by a limited extent, the bearing surfaces 17 come closer to each other thus enabling garments of different waistband sizes to be supported on the hanger. The resilience of the webs 13 urge the limbs 7 in the direction outwardly away from each other thus applying a force on the waistband of the garment which tends to retain the garment on the hanger.

By making the webs very thin, say 1 mm thick (a preferred range is 0.7–0.9 mm particularly 0.8 mm), there is limited tensile and compressive deformation within the material and low resultant stress in each web when the hanger is in use and this lessens the effect of creep which can occur in plastics materials when they are subjected to considerable strain. The resiliency can be assisted by a portion 20 of the webs in the centre of the length of the web which is less thick than the remainder of the web and which can be also or alternatively narrower than the remainder of the web.

I claim:

1. A garment hanger comprising an elongate bar, a hook member interconnected with and arranged generally perpendicular to the bar, a pair of limbs with each limb located in the region of a respective end portion of the bar and being remotely spaced from the respective end portion by at least two elongate parallel links connected between each limb and the respective end portion of the bar such that each limb is separately movable in a direction parallel to the respective end portion of the bar, the at least two parallel links of each limb being hingedly secured to both said limb and respective end portion and being resilient to permit limited movement of the limbs towards each other, and garment gripping means located on each limb at the outermost end thereof to prevent slipping of a garment hung on the hanger.

2. A garment hanger according to claim 1 wherein at the outer end of each limb there is a portion directed outwardly and upwardly to the garment gripping means.

3. A garment hanger according to claim 1 wherein the end portions are inclined upwardly from the centre of the elongate bar.

4. A garment hanger according to claim 1, wherein the parallel links comprise leaf springs.

5. A garment hanger according to claim 4 wherein the hanger is of an integral plastics moulding and the leaf springs are a multiplicity of parallel webs.

6. A garment hanger according to claim 5 wherein each web has a central portion of reduced dimension.

7. A garment hanger according to claim 6 wherein the reduced dimension is at least one of reduced width and thickness.

8. A garment hanger according to claim 1, wherein the garment gripping means on each limb comprises a roughened portion on the outer surface on the end of the limb.

9. A garment hanger comprising an elongate bar, a hook member interconnected with and arranged generally perpendicular to the bar, a pair of limbs with each limb located in the region of a respective end portion of the bar and being remotely spaced from the respective end portion by at least two elongate parallel links connected between each limb and the respective end portion of the bar such that each limb is separately movable in a direction parallel to the respective end portion of the bar, the at least two parallel links of each limb being hingedly secured to both said limb and respective end portion and being resilient to permit limited movement of the limbs towards each other, each limb having a connectable portion interconnected by said parallel links with the respective end portion of the bar, a gripper portion having gripping means located on an outermost surface thereof to prevent slipping of a garment hung on the hanger, and a guide portion interconnected between the connector and gripper portion so as to extend downwardly and inwardly of each gripping portion to the respective connector portion to a distance apart less than the waist width of a garment to be hung on the hanger.

10. A garment hanger according to claim 9 wherein said end portions are inclined upwardly from the centre of said elongate bar.

11. A garment hanger according to claim 9, wherein the connector portion of each limb is mounted at the lower end if each of said guide portions to extend inwardly thereof and is parallel to its respective end portion of the elongate bar.

12. A garment hanger comprising an elongate bar, a hook member interconnected with and arranged generally perpendicular to the bar, a pair of limbs with each limb located in the region of a respective end portion of the bar and being remotely spaced from the respective end portion by at least two elongate parallel links connected between each limb and the respective end portion of the bar such that each limb is separately movable in a direction parallel to the respective end portion of the bar, the at least two parallel links of each limb being hingedly secured to both said limb and respective end portion and being resilient to permit limted movement of the limbs towards each other, each link having a central portion of rdcuded thickness, and garment gripping means located on each limb at the outermost end thereof to prevent slipping of a garment hung on the hanger.

13. A garment hanger comprising an elongate bar, a hook member interconnected with and arranged generally perpendicular to the bar, a pair of limbs with each limb located in the region of a respective end portion of the bar and being remotely spaced from the respective end portion by at least two elognate parallel links connected between each limb and the respective end portion of the bar such that each limb is separately movable in a direction parallel to the respective end portion of the bar, the at least two parallel links of each limb being hingedly secured to both said limb and respective end portion and being resilient to permit limited movement of the limbs towards each other, each link having a central portion of reduced thickness, and each limb having a connectable portion interconnected by said parallel links with the respective end portion of the bar, a gripper portion having gripping means located on an outermost surface thereof to prevent slipping of a garment hung on the hanger, and a guide portion interconnected between the connector and gripper portions so as to extend downwardly and inwardly of each gripping portion to the respective connector portion to a distance apart less than the waist width of a garment to be hung on the hanger.

* * * * *

UNITED STATES PATENT AND TRADEMARK OFFICE

CERTIFICATE OF CORRECTION

PATENT NO. : 4,618,080

DATED : October 21, 1986

INVENTOR(S) : SHALSON, Peter

It is certified that error appears in the above-identified patent and that said Letters Patent is hereby corrected as shown below:

Column 5, line 29 which reads "rdcuded" should read -- reduced --.

Column 6, line 9 which reads "elognate" should read -- elongate --.

Signed and Sealed this

Seventeenth Day of February, 1987

*Attest:*

DONALD J. QUIGG

*Attesting Officer* *Commissioner of Patents and Trademarks*